US007168969B1

(12) United States Patent
Wang

(10) Patent No.: US 7,168,969 B1
(45) Date of Patent: Jan. 30, 2007

(54) ADJUSTABLE RIGHT ANGLE ELECTRICAL PLUG WITH AN INTERCHANGEABLE PLUG ASSEMBLY

(75) Inventor: Sword Wang, Hsin-Tien (TW)

(73) Assignee: Leader Electronics Inc., Taipei Hsien (TW)

( * ) Notice: Subject to any disclaimer, the term of this patent is extended or adjusted under 35 U.S.C. 154(b) by 0 days.

(21) Appl. No.: 11/432,625

(22) Filed: May 12, 2006

(51) Int. Cl.
*H01R 29/00* (2006.01)

(52) U.S. Cl. ..... 439/173; 439/518

(58) Field of Classification Search ..... 439/170–175, 439/18–30, 52, 53, 11, 13, 518
See application file for complete search history.

(56) References Cited

U.S. PATENT DOCUMENTS 4,973,827 A * 11/1990 Nozaki ..... 219/521
5,613,863 A * 3/1997 Klaus et al. ..... 439/131
5,634,806 A * 6/1997 Hahn ..... 439/173
5,744,934 A * 4/1998 Wu ..... 320/111
5,848,907 A * 12/1998 Chen ..... 439/172
5,997,310 A * 12/1999 Chiu et al. ..... 439/21
6,039,608 A * 3/2000 Amero et al. ..... 439/651
6,089,921 A * 7/2000 Chou ..... 439/640
6,109,977 A * 8/2000 Baxter et al. ..... 439/693
6,227,888 B1 * 5/2001 Hahn ..... 439/173
6,328,581 B1 * 12/2001 Lee et al. ..... 439/106
6,332,794 B1 * 12/2001 Tzeng Jeng ..... 439/188
6,364,716 B1 * 4/2002 Seo ..... 439/640
6,371,815 B1 * 4/2002 Wetzel et al. ..... 439/651
6,520,787 B1 * 2/2003 Lott ..... 439/218
6,544,058 B1 * 4/2003 Chang ..... 439/173
6,592,386 B2 * 7/2003 Teng et al. ..... 439/172
6,595,782 B1 * 7/2003 Hsiao ..... 439/13
6,638,074 B1 * 10/2003 Fisher ..... 439/22
6,669,495 B2 * 12/2003 Philips et al. ..... 439/170
6,749,451 B2 * 6/2004 Schmitt ..... 439/218
6,773,282 B2 * 8/2004 Alvey ..... 439/170
6,793,499 B1 * 9/2004 Chen ..... 439/13
6,821,134 B2 * 11/2004 Chen ..... 439/131
6,845,023 B2 * 1/2005 Philips et al. ..... 363/132
6,884,125 B2 * 4/2005 Chen ..... 439/848
6,923,667 B1 * 8/2005 Chen ..... 439/172
6,942,508 B2 * 9/2005 Wong ..... 439/171
6,988,903 B1 * 1/2006 Cheng ..... 439/137
7,008,246 B2 * 3/2006 Zhuge ..... 439/173
7,066,767 B2 * 6/2006 Liao ..... 439/639
2003/0211767 A1 * 11/2003 Philips et al. ..... 439/170
2005/0136717 A1 * 6/2005 Lai ..... 439/170

(Continued)

*Primary Examiner*—Ross Gushi
(74) *Attorney, Agent, or Firm*—Rosenberg, Klein & Lee

(57) ABSTRACT

An adjustable right angle electrical plug with an interchangeable plug assembly has a casing, an interchangeable plug assembly and an electric cord. The casing is hollow and has a base, a cover and two resilient contacts. The cover is mounted on the base and has a plug recess. The plug recess is symmetric. The resilient contacts protrude into the plug recess. The interchangeable plug assembly is mounted detachably in the plug recess has a body, two prongs and a bottom cover. The body is hollow, corresponds to the plug recess and has an open bottom. The prongs are mounted through and protrude from the body and may be flat blades or cylindrical prongs. The bottom cover has two curved contacts. Each curved contact extends through the bottom cover at two places separated by 90°, makes contact with one of the resilient contacts and is connected to one of the prongs.

8 Claims, 7 Drawing Sheets

U.S. PATENT DOCUMENTS

2005/0176281 A1* 8/2005 Zhuge ..... 439/173
2006/0068608 A1* 3/2006 McFadden ..... 439/22
2006/0141842 A1* 6/2006 Sauer ..... 439/344

* cited by examiner

ADJUSTABLE RIGHT ANGLE ELECTRICAL PLUG WITH AN INTERCHANGEABLE PLUG ASSEMBLY

BACKGROUND OF THE INVENTION

1. Field of Invention

The present invention relates to a right angle electrical plug, and more particularly to a right angle electrical plug that has an interchangeable plug assembly that can be easily removed and replaced to plug the right angle electrical plug into 50 Hz or 60 Hz outlets.

2. Description of the Related Art

Electric products such as computers, household appliances, lamps, chargers and the like often use right angle electrical plugs. A right angle electrical plug is often a thin elongated box, a pair of prongs and an electric cord, and 50 Hz or 60 Hz power is provided from an electrical receptacle. The box has an internal cavity, a circuit and two sides. The circuit is mounted in the internal cavity. Each side has two short edges. The prongs are mounted on and protrude from one side near a short edge. The receptacle comprises multiple pairs of outlet holes.

However, the outlet holes in 50 Hz and 60 Hz receptacles are significantly different, and the prongs on a plug for a 50 Hz receptacle will not plug into a 60 Hz receptacle. At the very best, changing the prongs on a conventional right angle electrical plug is inconvenient and can easily damage the right angle electrical plug. Using 50 Hz/60 Hz or 60 Hz/50 Hz adapter causes the right angle electrical plug to be offset from the receptacle and defeats the ultimate purpose of the right angle electrical plug.

To overcome the shortcomings, the present invention provides an adjustable right angle electrical plug to mitigate or obviate the aforementioned.

SUMMARY OF THE INVENTION

The primary objective of the present invention is to provide an adjustable right angle electrical plug that has an interchangeable plug assembly to allow the adjustable right angle electrical plug to be used with either a 50 Hz or 60 Hz receptacle by quickly and easily changing the interchangeable plug assembly.

To achieve the objective, the adjustable right angle electrical plug has a casing, an interchangeable plug assembly and an electric cord. The casing is hollow and comprises a base, a cover and two resilient contacts. The cover is mounted on the base and has a plug recess. The plug recess is symmetric. The resilient contacts protrude into the plug recess. The interchangeable plug assembly is mounted detachably in the plug recess has a body, two prongs and a bottom cover. The body is hollow, corresponds to the plug recess and has an open bottom. The prongs are mounted through and protrude from the body and may be flat blades for a 60 Hz receptacle or cylindrical prongs for a 50 Hz receptacle. The bottom cover is mounted in and closes the open bottom and has two curved contacts. Each curved contact extends through the bottom cover at two places separated by 90°, makes the contact with one of the resilient contacts and is connected to one of the prongs. The electrical cord is connected to the resilient contacts and an electrical device. Since the interchangeable plug assembly can be easily and quickly changed, the adjustable right angle electrical plug in accordance with the present invention can be used with either 50 Hz or 60 Hz receptacles without having to purchase the adjustable right angle electrical plugs.

Other objectives, advantages and novel features of the invention will become more apparent from the following detailed description when taken in conjunction with the accompanying drawings.

DETAILED DESCRIPTION OF THE INVENTION

Figure 1:
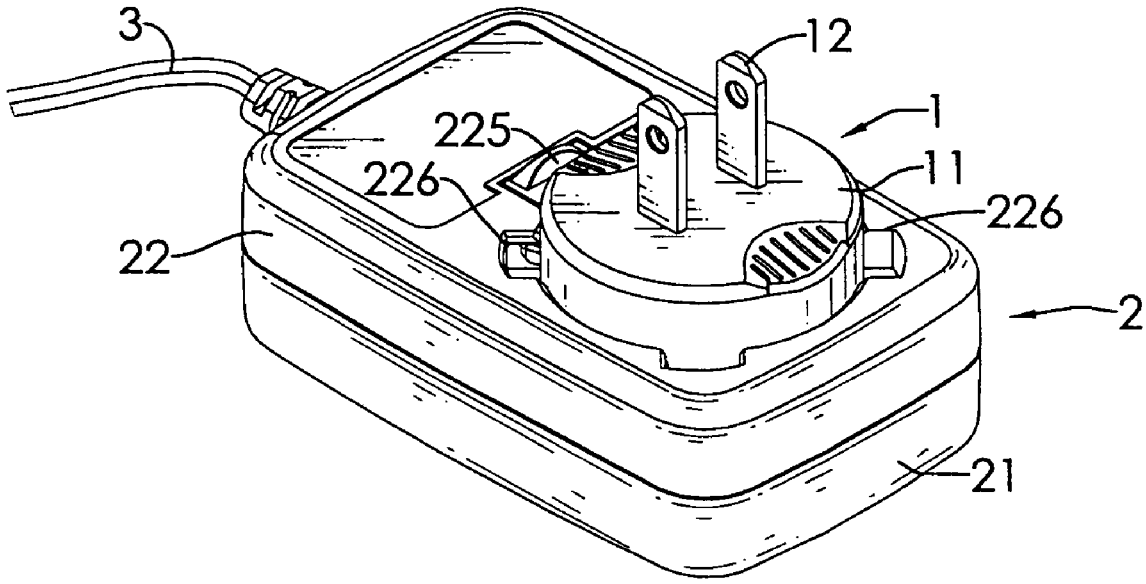
FIG. 1 is a perspective view of an adjustable right angle electrical plug in accordance with the present invention.

With reference to FIG. 1, an adjustable right angle electrical plug with an interchangeable plug assembly in accordance with the present invention connects an electrical device to an electrical receptacle and has a casing (2), an interchangeable plug assembly (1) and an electric cord (3).

Figure 2:
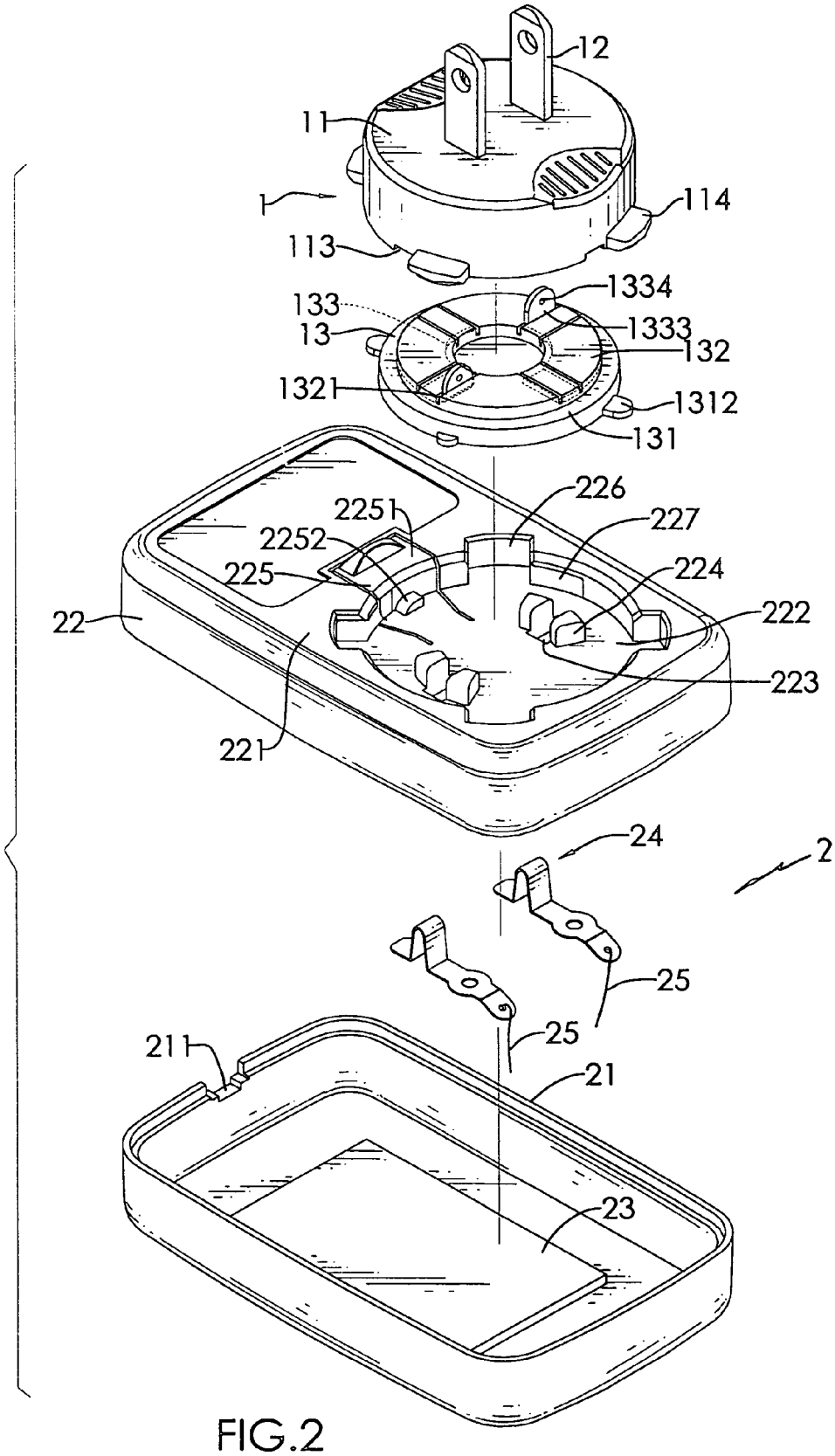
FIG. 2 is an exploded perspective view of the adjustable right angle electrical plug in FIG. 1.

With further reference to FIG. 2, the casing (2) is hollow and comprises a base (21), a cover (22), a circuit (23), two resilient contacts (24) and two wires (25).

The base (21) is an open rectangular box and has an open top, a front end, a rear end, an inside bottom surface, a sidewall, an optional lip and an optional cord notch (211). The sidewall has a top edge. The lip is formed on the top edge of the sidewall. The cord notch (211) is formed in the top edge of the sidewall at the rear end of the base (21) and extends below the lip.

The cover (22) is rectangular, corresponds to the base (21), is mounted on the top edge of the sidewall of the base (21) on the lip, closes the open top of the base (21) and has a sidewall, an open bottom, a top, a front end, a rear end, a plug recess (222), two contact openings (223), two optional pairs of guide and limit protrusions (224), multiple optional alignment slots (226), multiple optional retainer recesses (227) and an optional plug lock (225).

The sidewall corresponds to and is mounted flush on the sidewall of the base (21).

The top has an inside surface and an outside surface (221).

The plug recess (222) is symmetrical, may be circular, is formed in the outside surface (221) of the top near the front end of the cover (22) and has a bottom and a sidewall.

The contact openings (223) are formed through the bottom of the plug recess (222) diametrically opposite to each other, and each contact opening (223) has two sides.

The pairs of guide and limit protrusions (224) are formed on and protrude up from the bottom of the plug recess (222) and respectively on opposite sides of the contact openings (223).

The alignment slots (226) are formed symmetrically in the sidewall of the plug recess (222) from the bottom of the plug recess (222) to the top of the cover (22).

The retainer recesses (227) are formed in the sidewall of the plug recess (222) at the bottom and communicate respectively with the alignment slots (226).

The plug lock (225) is formed in the plug recess (222) and the top of the cover (22) and has a resilient lever (2251) and a latch (2252). The resilient lever (2251) is formed in the bottom and sidewall of the plug recess (222) and the top of the cover (22) toward the rear end of the cover (22) between two alignment slots (226). The latch (2252) is formed on and protrudes up from the bottom of the plug recess (222) adjacent to the sidewall.

The circuit (23) is formed on the inside bottom surface of the base (21).

The resilient contacts (24) are attached to the inside surface of the top of the cover (22), protrude respectively through the contact openings (223) between the guide and limit protrusions (224) and extend above the guide and limit protrusions (224).

The wires (25) connect the circuit (23) to the resilient contacts (24).

The interchangeable plug assembly (1) is mounted in and protrudes from the plug recess (222) and has a body (11), two prongs (12) and a bottom cover (13).

Figure 3:
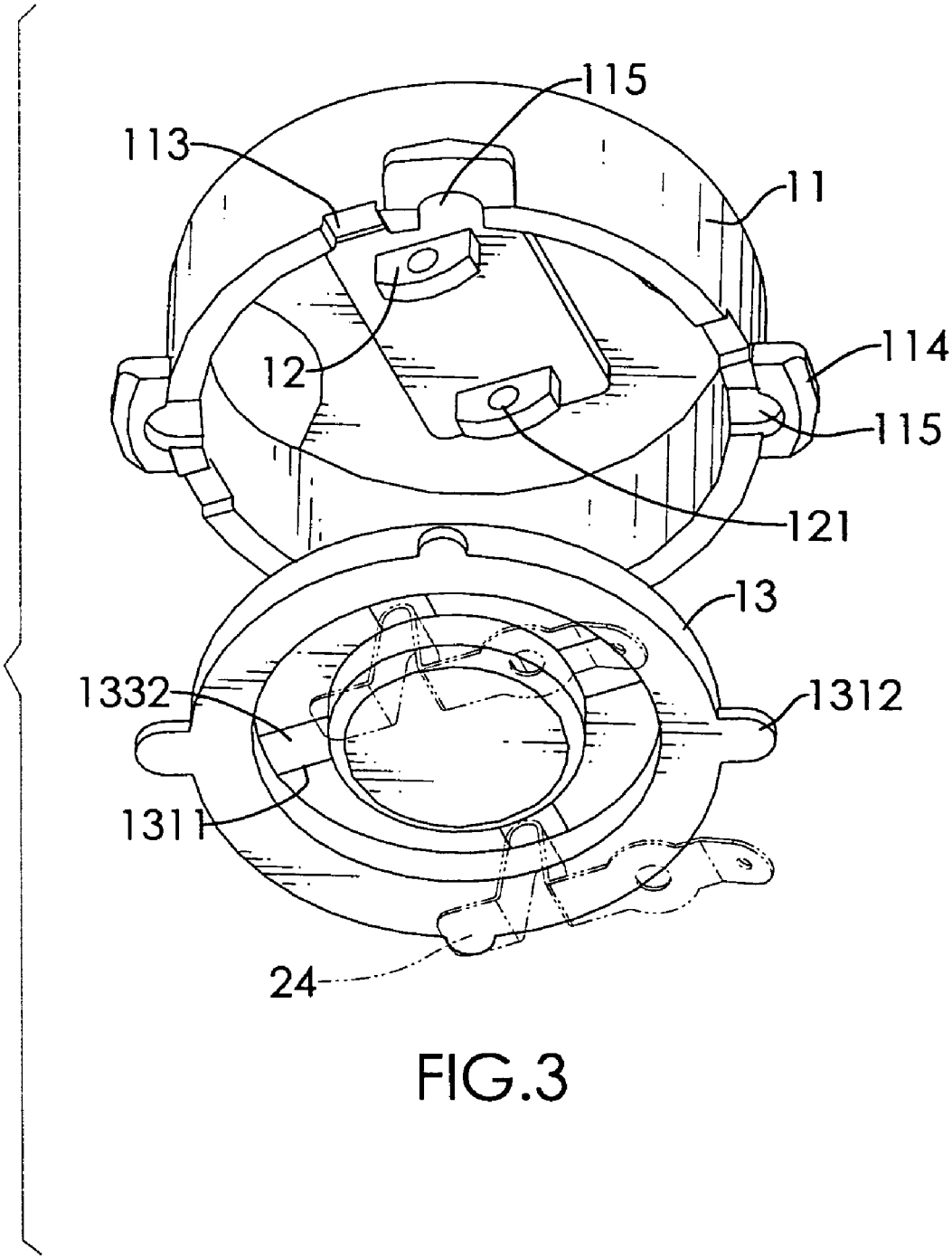
FIG. 3 is an exploded perspective view of an interchangeable plug assembly of the adjustable right angle electrical plug in FIG. 2.

With further reference to FIG. 3, the body (11) is symmetric and hollow, corresponds to the plug recess (222), may be circular and has a closed top, an open bottom, a sidewall, an inner cavity, a bottom edge, multiple connectors, four optional locking notches (113) and multiple mounting notches (115).

The closed top has an outer surface and an inner surface.

The sidewall has an outer surface.

The connectors are formed on the outer surface of the sidewall of the body (11) and hold the interchangeable plug assembly (1) in the plug recess (222) in the casing (2) and may be multiple blades (114). When the body (11) is circular, the blades (114) are formed on and protrude radially out from the bottom edge of the body (11), correspond respectively to the alignment slots (226) and move respectively into the retainer recesses (227) when the interchangeable plug assembly (1) is rotated in the plug recess (222) to hold the interchangeable plug assembly (1) securely in the plug recess (222).

The locking notches (113) are formed in the bottom edge of the body (11) and correspond to and are held by the latch (2252) of the plug lock (225) to hold the interchangeable plug assembly (1) in place.

The mounting notches (115) are formed in the bottom edge of the body (11).

Figure 6A:
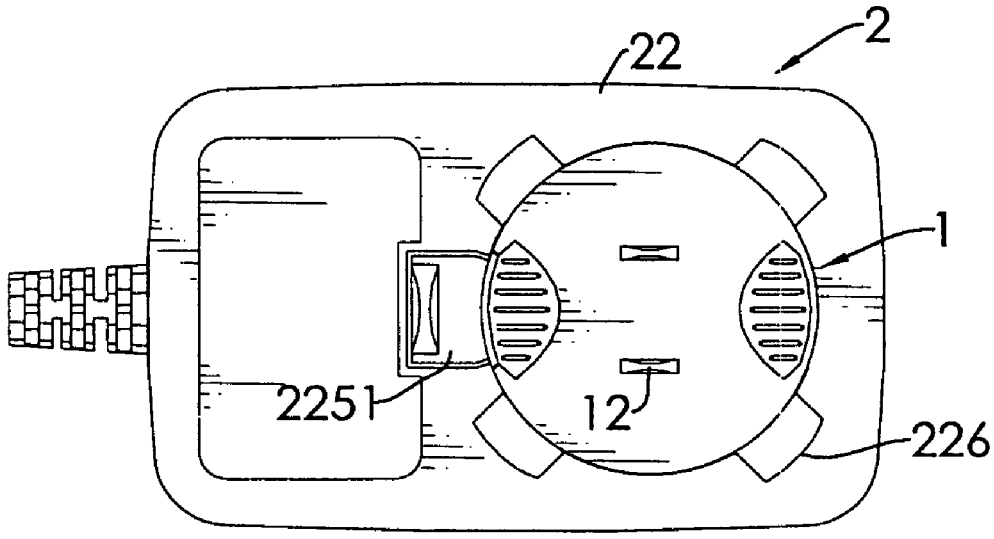
FIGS. 6A and 6B are operational top views of the adjustable right angle electrical plug in FIG. 1.
Figure 6B:
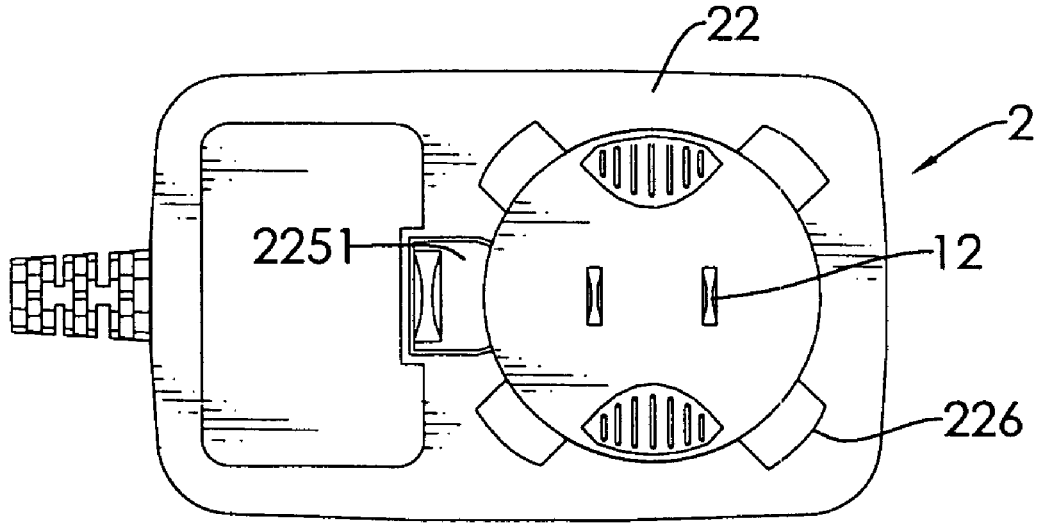

With further reference to FIG. 6, the prongs (12) are mounted through the closed top of the body (11), and each prong (12) has an outer end, an inner end and an optional through hole (121). The outer ends of the prongs (12) protrude from the outer surface of the closed top of the body (11) parallel to each other and may be oriented transversely or longitudinally relative to the casing (2) based on the orientation of the interchangeable plug assembly (1) in the plug recess (222). The inner ends of the prongs (12) protrude from the inner surface of the closed top of the body (11) and extend into the inner cavity of the body (11). The through holes (121) are formed respectively through the prongs (12) near the inner ends.

Figure 4:
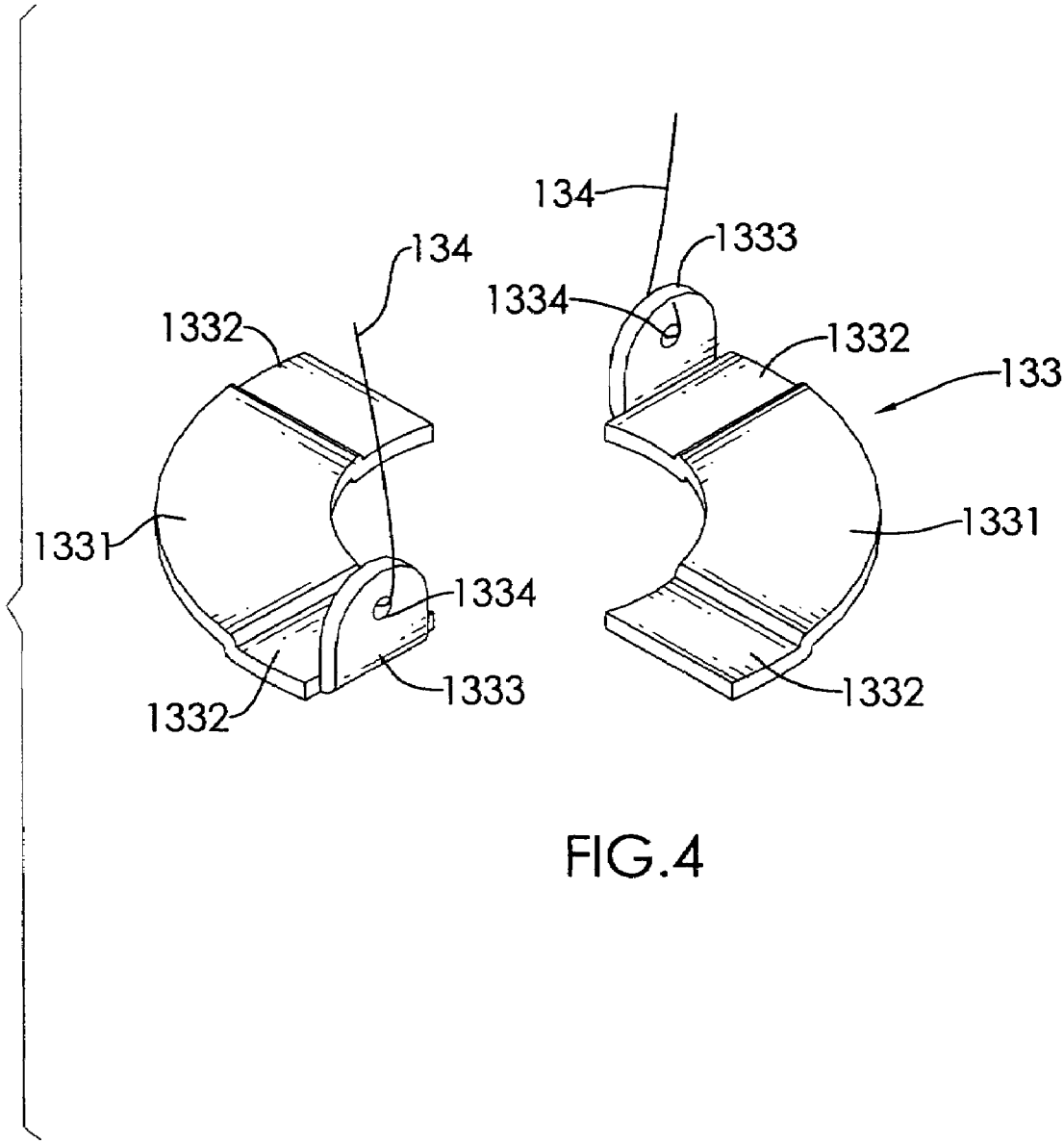
FIG. 4 is a perspective view of two curved contacts used in the interchangeable plug assembly of the adjustable right angle electrical plug in FIG. 2.
Figure 5:
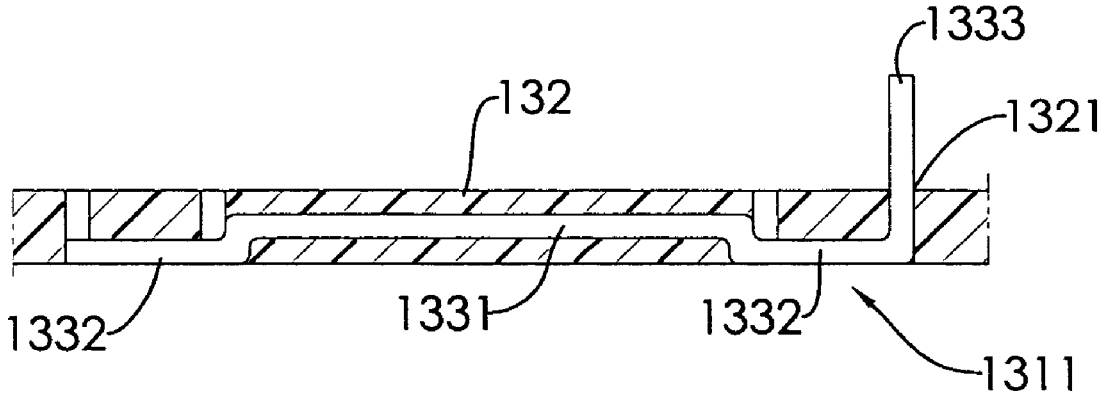
FIG. 5 is a partially cross sectional side view of the bottom cover of the interchangeable plug assembly of the adjustable right angle electrical plug in FIG. 2.

With further reference to FIGS. 4 and 5, the bottom cover (13) attaches to, closes and corresponds to the open bottom of the body (11), is mounted on the guide and limit protrusions (224), abuts the bottom of the plug recess (222) and has a base layer (131), two curved contacts (133), a contact layer (132) and two wires (134).

The base layer (131) attaches to the open bottom of the body (11) and has a center, a top surface, a bottom surface, an outer edge two contact recesses, four contact openings (1311) and multiple optional mounting tabs (1312). The contact recesses are curved and are formed in the top surface of the base layer (131), and each contact recess has two ends. The contact openings (1311) are formed through the base layer (131) at 90° intervals and respectively at ends of the contact recesses. The mounting tabs (1312) are formed on and protrude out from the outer edge and correspond to and are mounted in the mounting notches (115) in the body (11) to connect the bottom cover (13) to the body (11) and maintain the orientation of the contact openings (1311) and the prongs (12).

The curved contacts (133) are mounted respectively in the contact recesses and are exposed through the contact openings (1311), and each curved contact (133) has a central connecting strip (1331), two contacts (1332), a connecting tab (1333) and an optional through hole (1334).

The connecting strips (1331) are curved and are mounted respectively in the contact recesses in the base layer (131), and each connecting strip (1331) has two ends.

Figure 7A:
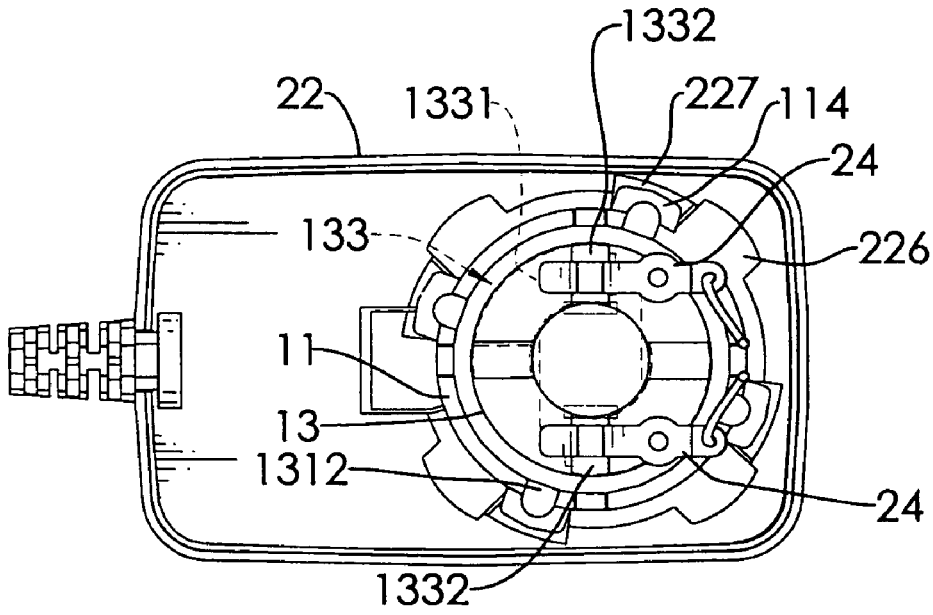
FIGS. 7A and 7B are partially operational bottom schematics of the adjustable right angle electrical plug in FIG. 1.
Figure 7B:
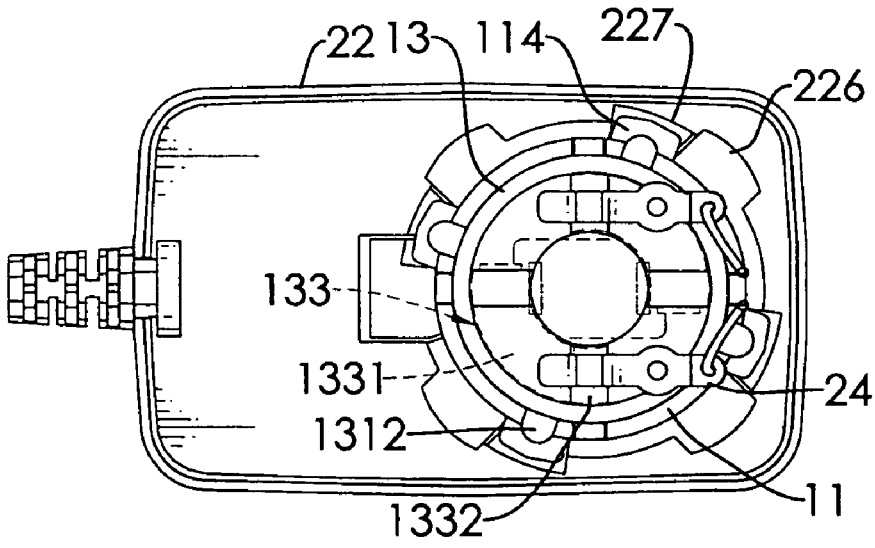

The contacts (1332) are formed respectively on and extend longitudinally from the ends of the connecting strip (1331), are offset down slightly from the connecting strip (1331), are separated by 90° and are mounted respectively in and are exposed through adjacent contact openings (1311) in the base layer (131). With further reference to FIG. 7, one of the contacts (1332) on each curved contact (133) is always in contact with one of the resilient contacts (24) protruding into the plug recess (222) when the interchangeable plug assembly (1) is mounted in the plug recess (222).

The connecting tab (1333) is formed on and protrudes perpendicularly up from one of the contacts (1332).

The through hole (1334) is formed through the connecting tab (1333).

The contact layer (132) is attached to the top surface of the base layer (131), holds the curved contacts (133) respectively in the contact recesses and the contact openings (1311) of the base layer (131) and has at least two through slots (1321). The through slots (1321) correspond to and are mounted respectively on the connecting tabs (1333) of the curved contacts (133).

The wires (134) electrically connect the curved contacts (133) respectively to the prongs (12) and may attach between the through holes (1334) in the connecting tabs (1333) and the through holes (121) in the prongs (12).

The electric cord (3) electrically connects the casing (2) to an electrical device, passes through the cord notch (211) in the base (21) of the casing (2) and has a proximal end and a distal end. The proximal end is connected electrically to the circuit (23) in the base (21). The distal end is connected to an electrical device.

The adjustable right angle electrical plug as describe has numerous advantages. The curved contacts (133) connect respectively to the prongs (112) and have four contacts (1332) at 90° intervals. When the interchangeable plug assembly (1) rotated 90°, two of the contacts (1332) on opposite curved contacts (133) contact the resilient contacts in the casing (2). Consequently, the prongs (12) can change orientation to be aligned longitudinally or transversely with the casing (2) and the casing (2) will not cover or obstruct other holes in a receptacle so the receptacle can be fully utilized.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An adjustable right angle electrical plug with an interchangeable plug assembly comprising a casing being hollow and comprising a base being an open box and having an open top;

a front end;

a rear end;

an inside bottom surface; and a sidewall having a top edge;

a cover corresponding to the base, mounted on the top edge of the sidewall of the base, closing the open top of the base and having a sidewall corresponding to and mounted flush on the sidewall of the base;

an open bottom;

a top having an inside surface; and an outside surface;

a front end;

a rear end;

a plug recess being symmetrical, formed in the outside surface of the top near the front end of the cover and having a bottom and a sidewall; and two contact openings formed through the bottom of the plug recess diametrically opposite to each other, and each contact opening having two sides;

a circuit mounted on the inside bottom surface of the base;

two resilient contacts attached to the inside surface of the top of the cover and protruding respectively through the contact openings; and two wires connecting the circuit to the resilient contacts;

an interchangeable plug assembly mounted in and protruding from the plug recess and having a body being symmetric and hollow, corresponding to the plug recess and having a closed top having an outer surface; and an inner surface;

an open bottom;

a sidewall having an outer surface;

an inner cavity;

a bottom edge; and multiple connectors formed on the outer surface of the sidewall of the body;

two prongs mounted through the closed top of the body, and each prong having an outer end protruding from the outer surface of the closed top of the body parallel to the other prong; and an inner end protruding from the inner surface of the closed top of the body and extending into the inner cavity of the body; and a bottom cover attaching to, closing and corresponding to the open bottom of the body, abutting the bottom of the plug recess and having a base layer attached to the open bottom of the body and having a center;

a top surface;

a bottom surface;

an outer edge;

two contact recesses being curved and formed in the top surface of the base layer, and each contact recess having two ends; and four contact openings being formed through the base layer at 90° intervals and respectively at ends of the contact recesses;

two curved contacts mounted respectively in the contact recesses, exposed through the contact openings, and each curved contact having a central connecting strip being curved and mounted respectively in the contact recesses in the base layer and each connecting strip having two ends;

two contacts formed respectively on and extending longitudinally from the ends of the connecting strip, being offset down slightly from the connecting strip, being separated by 90° and mounted respectively in and exposed through adjacent contact openings in the base layer; and a connecting tab formed on and protruding perpendicularly up from one of the contacts; and a contact layer attached to the top surface of the base layer, holding the curved contacts respectively in the contact recesses and the contact openings of the base layer and having at least two through slots corresponding to and mounted respectively on the connecting tabs of the curved contacts; and two wires electrically connecting the curved contacts respectively to the prongs; and an electric cord electrically connecting the casing to an electrical device and having a proximal end connected electrically to the circuit in the base.

2. The adjustable right angle electrical plug as claimed in claim 1, wherein the base further has a cord notch formed in the top edge of the sidewall at the rear end of the base; and the electric cord extends through the cord notch.

3. The adjustable right angle electrical plug as claimed in claim 1 wherein each prong further has a through hole formed near the inner end;

each curved contact further has a through hole formed through the connecting tab; and the wires of the interchangeable plug assembly are attached between the through holes in the connecting tabs and the through holes in the prongs.

4. The adjustable right angle electrical plug as claimed in claim 1 wherein the body of the interchangeable plug assembly further has multiple mounting notches formed in the bottom edge of the body; and the base layer of the cover of the interchangeable plug assembly further has multiple mounting tabs formed on and protruding out from the outer edge and corresponding to and mounting in mounting notches in the body.

5. The adjustable right angle electrical plug as claimed in claim 1, wherein the base further has a lip formed on the top edge of the sidewall; and the cover is mounted on the lip.

6. The adjustable right angle electrical plug as claimed in claim 5 wherein the base further has a cord notch formed in the top edge of the sidewall at the rear end of the base and extending below the lip; and the electric cord extends through the cord notch.

7. The adjustable right angle electrical plug as claimed in claim 1 wherein the plug recess is circular;

the cover further has two pairs of guide and limit protrusions formed on and protruding up from the bottom of the plug recess and respectively on opposite sides of the contact openings;

multiple alignment slots formed symmetrically in the sidewall of the plug recess from the bottom of the plug recess to the top of the cover; and multiple retainer recesses formed in the sidewall of the plug recess at the bottom and communicating respectively with the alignment slots;

the resilient contacts protrude between the guide and limit protrusions and extend above the guide and limit protrusions;

the body of the interchangeable plug assembly is circular; and the connectors on the body are blades formed on and protruding radially out from the bottom edge of the body, corresponding respectively to the alignment slots and movably held respectively in the retainer recesses.

8. The adjustable right angle electrical plug as claimed in claim 7 wherein the cover further has a plug lock formed in the plug recess and the top of the cover and having a resilient lever formed in the bottom and sidewall of the plug recess and the top of the cover toward the rear end of the cover between two alignment slots; and a latch formed on and protruding up from the bottom of the plug recess adjacent to the sidewall; and the body of the interchangeable plug assembly further has four locking notches formed in the bottom edge of the body and corresponding to and held by the latch of the plug lock.

* * * * *